US005682622A

United States Patent [19]

Tagg

[11] Patent Number: 5,682,622

[45] Date of Patent: Nov. 4, 1997

[54] PORTABLE STAND-ALONE RESTROOM FACILITY WITH HANDICAP ACCESS

[75] Inventor: Richard Leach Tagg, Sandhutton, England

[73] Assignee: Polyjohn Enterprises Corporation, Whiting, Ind.

[21] Appl. No.: 618,870

[22] Filed: Mar. 20, 1996

[51] Int. Cl.[6] ..... A47K 11/00

[52] U.S. Cl. ..... 4/449; 4/459; 52/79.1; 52/79.4

[58] Field of Search ..... 4/449, 462, 463, 4/476–480, 604, 611, 459; 52/79.1, 79.4, 264

[56] References Cited

U.S. PATENT DOCUMENTS

| | | | |
|---|---|---|---|
| D. 248,775 | 8/1978 | Brown . | |
| D. 275,520 | 9/1984 | Harding et al. . | |
| 3,302,547 | 2/1967 | Wasserman . | |
| 3,776,383 | 12/1973 | Hargraves . | |
| 3,873,445 | 3/1975 | Bussard . | |
| 4,152,789 | 5/1979 | Heath | 4/611 X |
| 4,446,585 | 5/1984 | Harding et al. . | |
| 4,493,118 | 1/1985 | Braxton . | |
| 4,987,619 | 1/1991 | Smith | 4/611 X |
| 5,398,465 | 3/1995 | Tagg | 4/79.1 |

FOREIGN PATENT DOCUMENTS 28 43 301 4/1980 Germany .

*Primary Examiner*—Charles E. Phillips
*Attorney, Agent, or Firm*—Harness, Dickey & Pierce, P.L.C.

[57] ABSTRACT

A multi-sided portable cabana that exhibits increased structural integrity and added dimensional qualities when compared to conventional cabanas, and that is also accessible to persons having physical disabilities. The cabana includes a generally flat, planar base and a plurality of interchangeable wall panels coupled to the base that extend generally perpendicularly upwardly from the base. A roof panel is affixed atop the plurality of wall panels. A door frame, including a door hingedly connected thereto, is positioned between two of the plurality of wall panels and includes a bottom edge generally co-planar with the flat base. Each of a plurality of wall connectors is positioned between adjacent wall panels in a lengthwise manner for coupling the adjacent wall panels. A wall rib is secured to an inner surface of at least two of the retainers and spaced apart therefrom to increase the structural integrity of the cabana, and to also provide persons with disabilities, such as those confined to wheelchairs, access to facilities housed within the cabana interior in compliance with regulations set forth by the Americans with Disabilities Act.

13 Claims, 4 Drawing Sheets

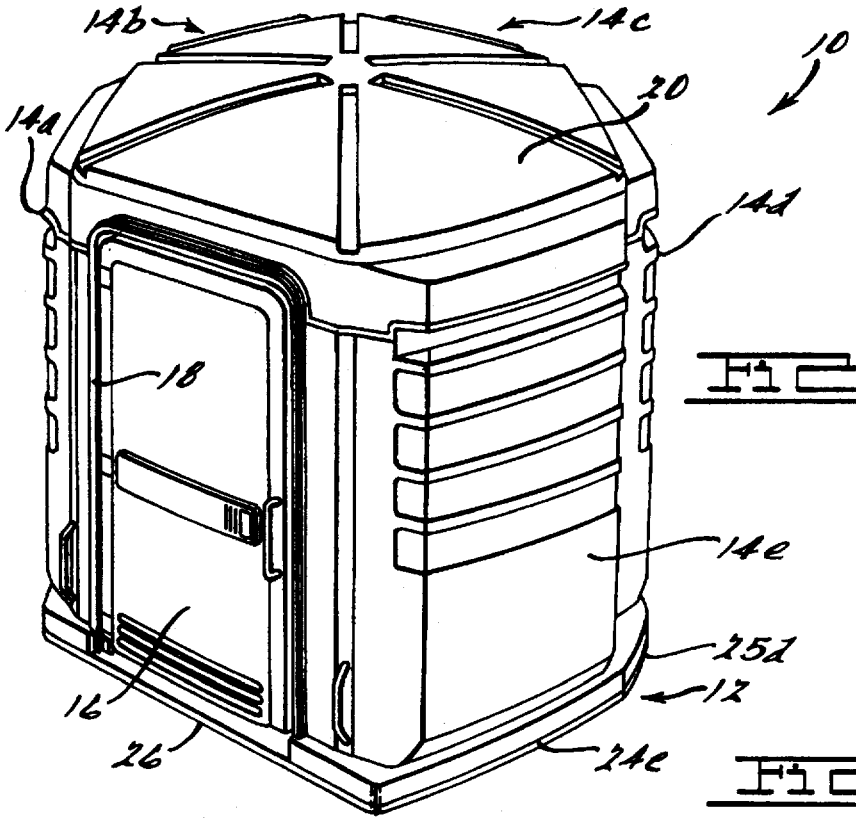
FIG. 1.
FIG. 2.
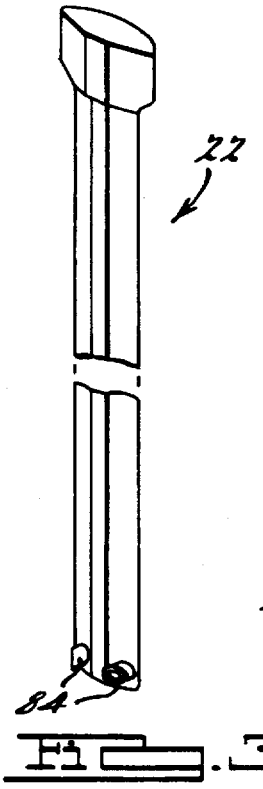
FIG. 3.
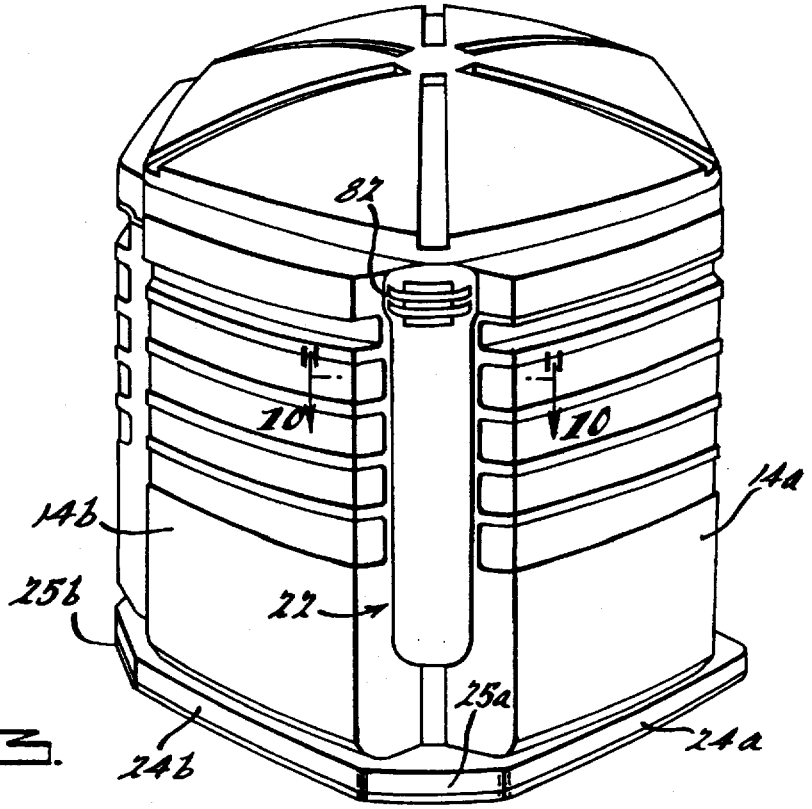

PORTABLE STAND-ALONE RESTROOM FACILITY WITH HANDICAP ACCESS

BACKGROUND OF INVENTION

This invention relates to the construction of a cabana of the type used for portable outdoor-type restroom facilities that has a reinforced structure and that is accessible to those who are physically disabled.

Portable stand-alone cabanas housing restroom facilities such as toilets and sinks provide people with restroom facilities at outdoor concerts, construction sites and other places of public gathering where such facilities would otherwise be unavailable. Conventional cabanas typically include walls constructed from relatively large, thin sheets of thermoplastic material such as polyethylene-type plastic. The walls may be flat or may include indentations, ribs or other similar type features as desired and define both the height and the width of the cabana enclosure. One wall panel typically includes a door frame with a door hingedly connected thereto for providing access to the interior of the cabana.

Conventional portable cabanas of the type described generally above vary widely in shape and size. Examples of such cabanas are disclosed generally in U.S. Pat. No. 3,835,480 to Harding for a "Chemical Toilet Cabana"; U.S. Pat. No. 3,447,167 to Harding for a "Portable Toilet Cabana"; U.S. Pat. No. 4,031,572 to Harding for a "Chemical Toilet Cabana Shell Section"; U.S. Pat. No. 4,577,351 to Harding for a "Portable Toilet Cabana"; U.S. Design Pat. No. 250,350 to Sargent for a "Portable Toilet Building"; U.S. Design Pat. No. 349,578 to Tagg, inventor of the present invention, for a "Portable Toilet"; and U.S. Design Pat. No. 304,082 to Harding for an "Outdoor Toilet Cabana."

In the above cabana structures, there is a practical limitation on the size of the plastic wall panels that depends upon the thickness of the wall panels, as the thermoplastic material used to form the wall panels is relatively resilient and tends to buckle or flex as the size of the wall panel is increased. When it is desired to build a cabana having larger inner dimensions, the dimensions of the wall panels may be enlarged by increasing the thickness of the wall panels. However, because the thermoplastic material used is relatively expensive, it is desirable to form the wall panels with a minimal thickness. In addition, such outdoor cabanas must be lightweight so as to be easily movable from one location to another. Therefore, increasing the amount of plastic and thickness of the wall panels increases the weight of the cabana and adds difficulty to the process of moving and positioning the cabana.

In certain types of cabana constructions, such as those designed to have dimensions large enough to accommodate persons who are disabled and who are confined to wheelchairs, it is desirable to increase the inner dimensions of the cabana in a manner beyond that which is attainable with four conventional formed plastic wall panels. Such cabanas having added dimensionally qualities are disclosed in U.S. Pat. No. 4,831,671 to Harding for a "Portable Toilet Cabana" and U.S. Pat. No. 4,918,765 to Harding for a "Portable Toilet Cabana". The cabanas disclosed in the aforementioned patents include corner panels that interlock with conventional wall panels to thereby expand the cabana inner dimensions without sacrificing the cabana structural integrity.

Although, the above patents disclose a cabana having added dimensional qualities, there is still room for further improvement in the art. For example, it would be desirable to construct a cabana having increased inner dimensions without comprising the structural integrity of the cabana, while at the same time providing for easy access to the cabana interior by disabled persons, especially those confined to wheelchairs, without the requirement of additional components such as cabana doorway ramped surfaces. In addition, it would be desirable to provide features within the cabana that make the cabana accessible to physically disabled persons without adding to the weight or complexity of the inner structure.

SUMMARY OF INVENTION

The invention contemplates an outdoor portable stand alone restroom facility constructed of interchangeable wall sections formed from sheets of plastic material. The structure of the present invention increases both structural integrity and cabana interior dimensions when compared to conventional outdoor restroom cabanas, and is constructed in a manner that permits access to the facilities housed within the structure by physically disabled persons, and specifically persons confined to wheelchairs.

In particular, the present invention provides a multi-sided portable cabana having a generally flat, planar base. A plurality of interchangeable wall panels are coupled to the base and extend generally perpendicularly upwardly from the base. A roof panel is affixed atop the plurality of wall panels. A door frame is positioned between two of the plurality of wall panels, and includes a bottom edge generally co-planar with the flat base. Each of a plurality of wall connectors is positioned between two adjacent wall panels to interlock the wall panels in a lengthwise manner. A wall rib is secured generally horizontally to an inner surface of at least two of the retainers and spaced apart therefrom to increase the structural integrity of the cabana. The wall rib additionally functions as a rail to enable people having physical impairments to access facilities housed within the cabana.

An object of this invention is to provide a modular portable outdoor structure constructed in a manner so as to exhibit a high degree of structural integrity, thereby increasing the life of the structure.

An object of the present invention is to provide a polygonal cabana having more than four sides that exhibits increased inner dimensions without sacrificing structural integrity.

Another object of the present invention is to provide a portable modular structure that is accessible to physically disabled persons, and in particular people confined to wheelchairs.

Another object of the present invention is to provide a modular stand-alone outdoor restroom facility having an interior structural support system that also functions as an access rail for the physically disabled to facilitate ease of use of facilities housed within the structure by physically disabled persons.

Still a further object of this invention is to provide a wall panel connector system that, in combination with an interiorly-mounted brace, connects modular wall panels forming a portable cabana to increase the structural integrity of the cabana.

Yet another object of this invention is to provide a portable stand-alone restroom facility that complies with all regulations set forth by the Americans with Disabilities Act (ADA).

These and other objects and advantages of this invention will become apparent upon reading the following description, of which the attached drawings form a part.

DESCRIPTION OF DRAWINGS

FIG. 1 is a perspective view of an outdoor restroom facility cabana according to a preferred embodiment of the present invention;

FIG. 2 is a rear elevational view of the cabana of FIG. 1;

FIG. 3 is a rear view of the vent stack shown in FIG. 2;

DETAILED DESCRIPTION

Figure 4:
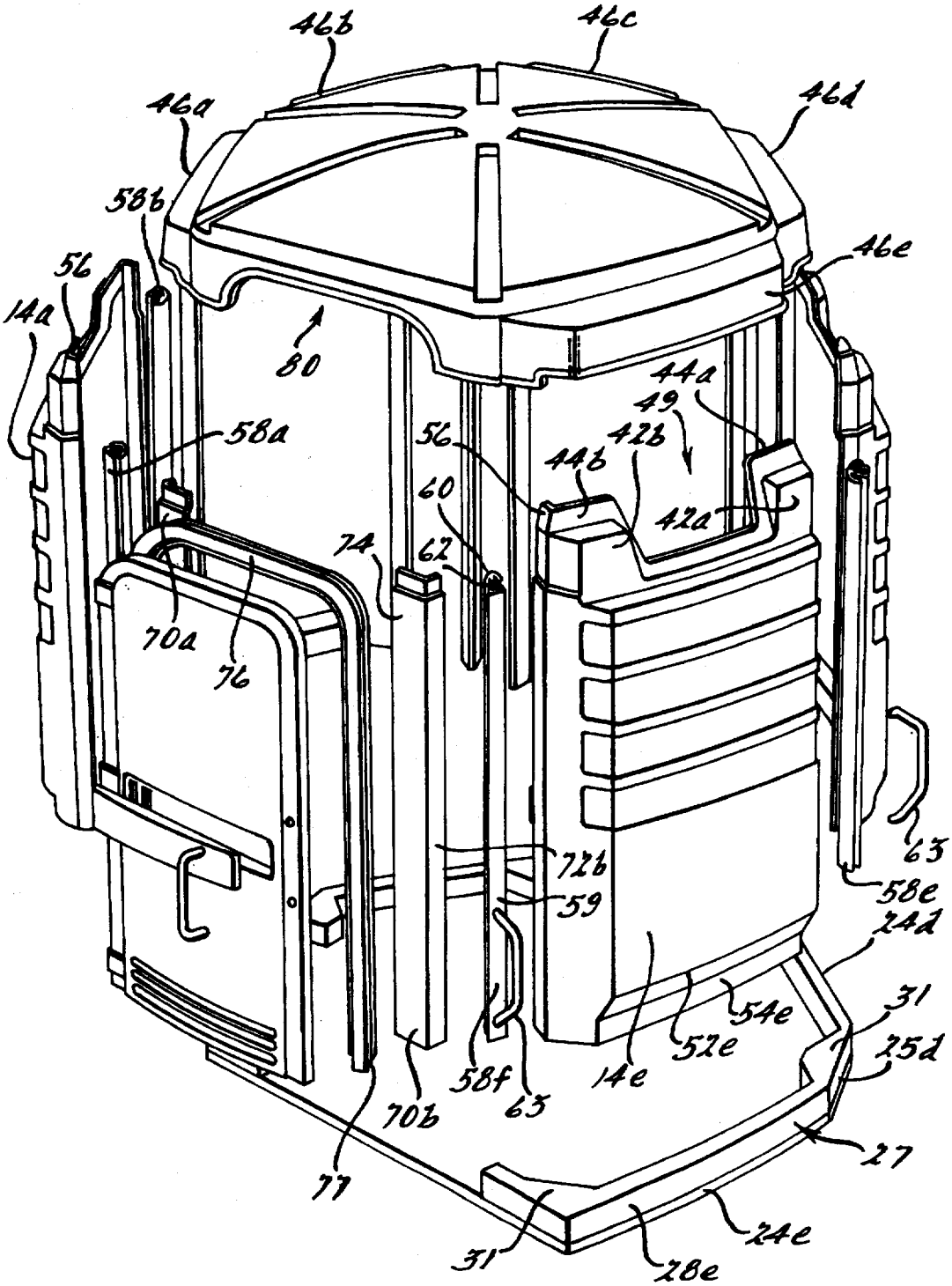
FIG. 4 is an exploded view of the outdoor cabana shell shown in FIG. 1.

Referring to the drawings; in which like numerals reference like parts, a transportable stand-alone cabana according to a preferred embodiment of the present invention is shown generally at 10. The cabana is a six-sided enclosure having a structure that increases both the cabana interior dimensions and the cabana structural integrity when compared to conventional four-sided toilet cabanas. The cabana 10 is lightweight, free standing and is capable of being moved or transported from one location to another with relative ease. Also, as will be described in more detail below, the cabana is also designed to conform with the guidelines set forth by the Americans with Disabilities Act (ADA), thereby making the interior of the cabana, and restroom facilities housed within the cabana interior, accessible to physically impaired persons, and particularly those confined to wheelchairs.

As shown in FIGS. 1 and 2, the cabana 10 includes a base 12 having five interchangeable wall panels 14*a*–14*e*, a door 16 hinged to a corresponding door frame 18, and a roof 20. As shown in FIG. 2, the rear of the cabana also includes a vent stack 22 fitted between two of the interchangeable panels for venting the enclosed area defined within the cabana in a manner well known in the art. The structure and function of each of the above-identified elements will be separately described in detail below.

Referring to FIG. 4, the base 12 is a generally flat planar sheet manufactured from reconstituted plastic. The base is multi-sided, including five sides 24*a*–24*e* of identical dimensions and preferably having a length of about 40–48 inches. Four intersection corners 25*a*–25*d* are located between adjacent sides 24*a*–24*e*. The outer edge of each side 24*a*–24*e* intersects with an outer edge of an adjacent intersection corner 25*a*–25*d* at an angle preferably of about 120°. A sixth side 26 corresponds to the location of the cabana door and door frame and is greater in length than the base sides 24*a*–24*e*, having a length of about 54 inches. The outer edge of the side 26 intersects the outer edge of the sides 24*a*, 24*e* at an angle preferably of about 90°.

Figure 5:
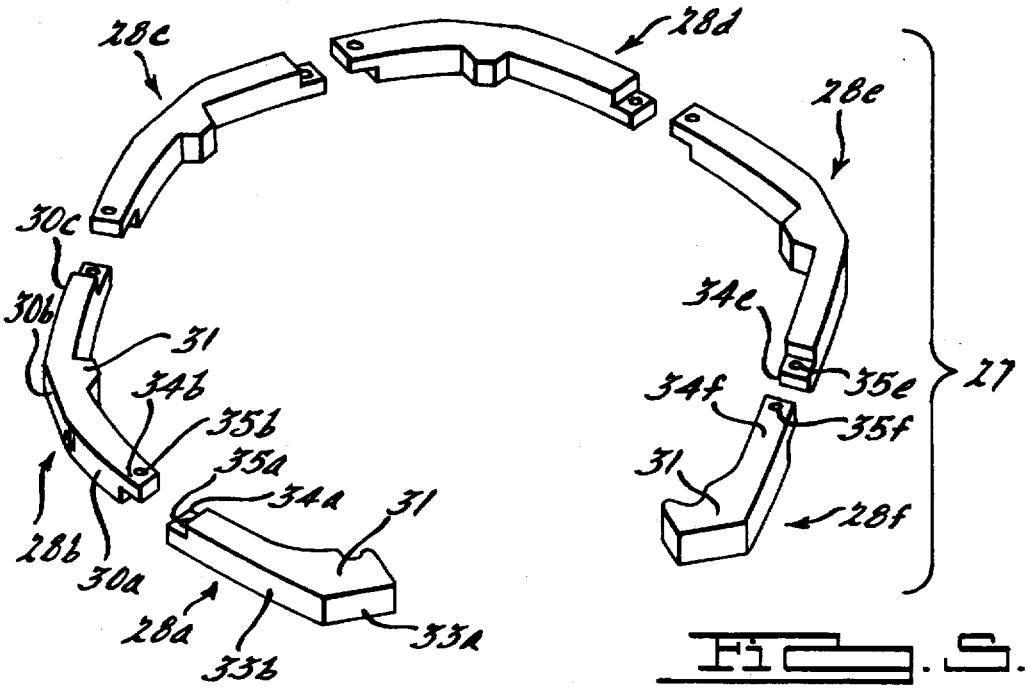
FIG. 5 is a perspective view of the structure of a first preferred embodiment of the cabana base surround shown in FIG. 1.

Further, the base includes a modular base surround, indicated generally at 27 in FIG. 4, that extends around the periphery of the five base sides 24*a*–24*e* and the four intersection corners 25*a*–25*d* and partially along the edge of the side 26 for correct placement of the door frame 18. As shown in a first embodiment in FIG. 5, the base surround is formed from a plurality of modular segments 28*a*–28*f*. The modular segments 28*a*, 28*f* conform to the corner defined by the intersection on the front base side 26 and the base sides 24*a*, 24*e*. The modular segments 28*b*–28*e* each include three subsegments, represented by subsegments 30*a*–30*c* on segment 28*b*, formed for placement around the outer periphery of the base.

The segments 28*a*, 28*f* are structured to have two subsegments, represented by the subsegments 33*a*, 33*b* of segment 28*a*, that conform to the outer periphery of the base at the intersection of the side 26 with the sides 24*a*, 24*e*. The subsegment 33*a* extends partially along the side 26 to define the position at which the door frame is to be placed. The subsegment 33*b* extends along the periphery of the side 24*a* and mates with surround segment 28*b* in a manner described below. Each segment 28*a*, 28*f* also includes a shoulder 31 for use in positioning of the wall panels.

Referring to the segment 28*b*, the base sides 24*a*, 24*b* and the intersecting corner 25*a*, with the understanding that the other segments 28*c*–28*e* are positioned in a like manner around the remaining sides and intersecting corners of the base, the subsegment 30*a* extends partially along the periphery of the side 24*a*, while the subsegment 30*c* extends partially along the periphery of the side 24*b*. The edge subsegment 30*b* extends along the entire periphery of the intersecting corner 25*a* and includes an interior shoulder 31 for facilitating correct positioning of the wall panels 14*a*, 14*b* as will be described below.

The surround segment 28*a* includes a female portion of a lap joint 34*a* at an inner end and an abutment face for correct positioning of the door frame 18 at its other end, while the surround segment 28*f* includes a male portion of a lap joint 34*f* at one end and an abutment face for correct positioning of the door frame 18 at its other end. The surround segments 28*b*–28*e* include female portions of a lap joint at first ends thereof mateable with male portions of a lap joint at opposing second ends thereof.

Referring to the segments 28*a*, 28*b*, and 28*e*, 28*f*, with it being understood that the lap joints of the interior surround segments are mateable in a like manner, the inner end of the surround segment 28*a* defining a female portion of a lap joint 34*a* includes an aperture 35*a*, while the inner end of the surround segment 28*f* defining the male portion of a lap joint 34*f* includes an aperture 35*f*. The female lap joint portion 34*a* of the segment 28*a* is mateable with a male lap joint portion 34*b* of the inner edge segment 28*b* including aperture 35*b*. Likewise, the male lap joint portion 34*f* is mateable a female lap joint portion 34*e* of the edge segment 28*e* including aperture 35*e*. The segments 28*a*, 28*b* and 28*e*, 28*f* are fixedly joined together through insertion of a rivet or other like fastener through the cooperating apertures 35*a*, 35*b* and 35*e*, 35*f* at the intersection of the lap joint segments.

Figure 6:
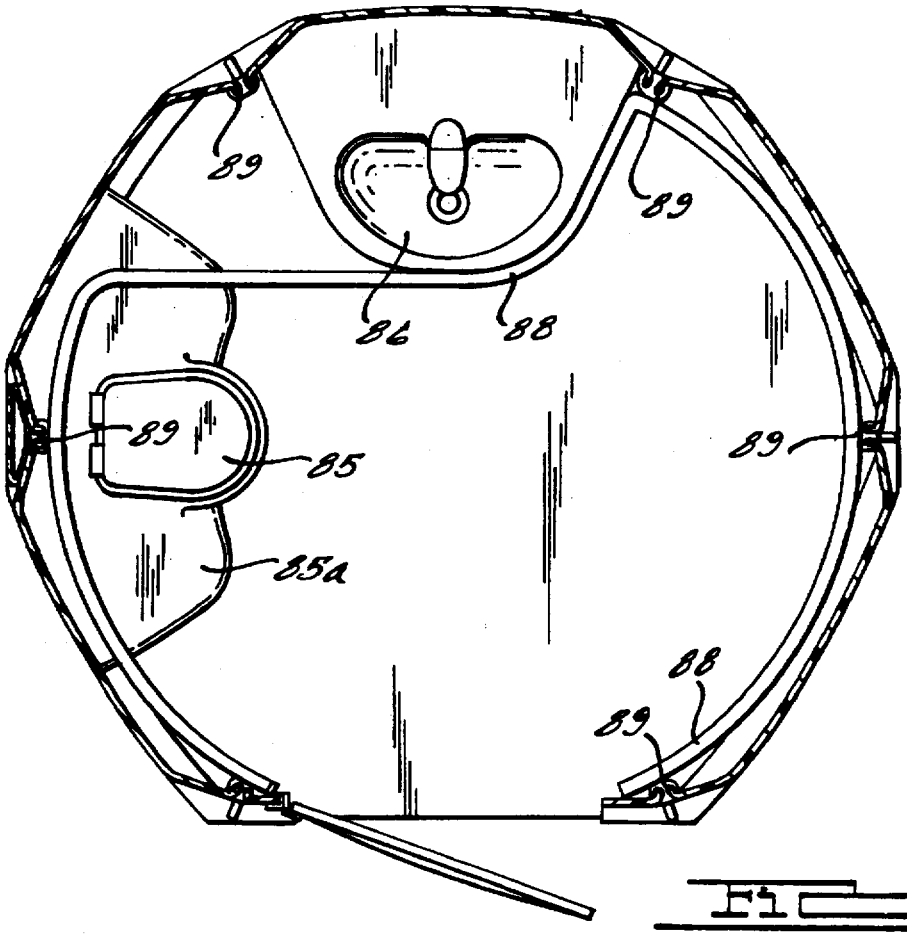
FIG. 6 is a perspective view of a second preferred embodiment of the cabana base surround shown in FIG. 1.

A second embodiment of the base surround is shown at 27' in FIG. 6. The base surround is formed from three segments 28*a*'–28*c*', as compared to the six-segment base surround of FIG. 5. The segment 28*a*' includes subsegments 30*a*'–30*f*' with subsegment 30*a*' including an inner face for use in positioning of the door frame 18. Subsegments 30*b*' and 30*d*' extend along base sides 24*a* and 24*b*, respectively, while subsegments 30*c*' and 30*e*' extend along intersection corners 25*a* and 25*b*, respectively. Subsegment 30*f*' extends partially along base side 24*c* and includes a female portion 34a' of an interlocking joint. Segment 28c' is formed in an identical, albeit mirror, image.

Figure 7:
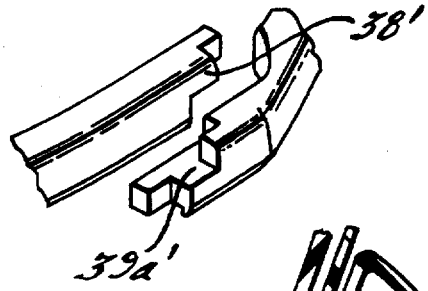
FIG. 7 is an enlarged view showing one of the interlocking joints of the cabana base surround of FIG, 6.

Still referring to FIG. 6, segment 28b' extends along base side 24c and includes male portions of interlocking joints that mate with female portions 34a', 34b' of the interlocking joints defined by segments 28a', 28b' to effectively form an integral base surround. As shown in FIGS. 6 and 7, the segment 28b' includes fingers 36a', 36b' that interlock with recesses 37a', 37b' defined by female portions 34a', 34b' of the interlocking joints and flanges at each end, such as the flange 38' shown in FIG. 7, that fit within recesses 39a', 39b' also defined by female portions 34a', 34b' of the interlocking joints. The interlocking joints thus effectively prevent forward, rearward and upward movement of the segment 28b' when correctly positioned between, and interlocked with, segments 28a' and 28c'. The segments 28a'–28c' may be secured to the base by countersink bolts or other equivalent fasteners.

Thus, the modular surround segments, when joined together in one of the aforementioned manners, form a continuous base support around the periphery of the base that increases the structural integrity of the cabana and ensures proper positioning of the wall panels 14a–14e. It should be mentioned at this point that the base surround could also be molded as a single continuous piece of rubber or plastic.

The wall panels 14a–14e are preferably made of thin, relatively resilient thermoplastic material such as polyethylene and have an associated thickness of approximately 0.125 inches. The wall panels are approximately 43 inches in width and 80 inches in height. However, the wall panel dimensions may be varied according to particular needs and applications. Referring to wall panel 14e, as shown in FIG. 4, with it being understood that the wall panels 14a–14d have identical structures, protrusions 42a, 42b are defined along the top of the wall panel, with each protrusion having an associated flange 44a, 44b. The protrusions 42a, 42b abut an inner surface of an extension 46e of the roof 20, while the wall panel flanges 44a, 44b frictionally engage with an inner edge (not shown) of the roof defined between the protrusion 46e and the roof 20 to maintain the roof 20 in contact with the wall panel 14e. The roof may be secured to the upper ends of the wall panels by rivets or other similar fasteners. A wall panel recess 49 is also defined between the flanges 42a, 42b. Additionally, each of the wall panels include a bottom edge, such as the edge 52e, having a recessed portion 54e that is mateable with a modular base surround segment when the wall panel is correctly positioned in place on the base 12 between adjacent shoulders 31. Two side strips 56 are formed along the sides of each wall panel and engage with two of the wall connectors 58a–58f in a manner to be described in detail below.

Still referring to FIG. 4, reference will be made to wall connector 58f, with it being understood that all wall connectors 58a–58f are identical in structure and function. The wall connector 58f is positioned in general perpendicular alignment with a shoulder 31. The wall connector 58f has a main triangularly shaped body with two securing strips 60 running along its length and a substantially flat exterior finished surface 59 visible from the exterior of the cabana 10. Each of the securing strips defines two slots 62 into which one of the side strips 56 of a wall panel is inserted.

Figure 10:
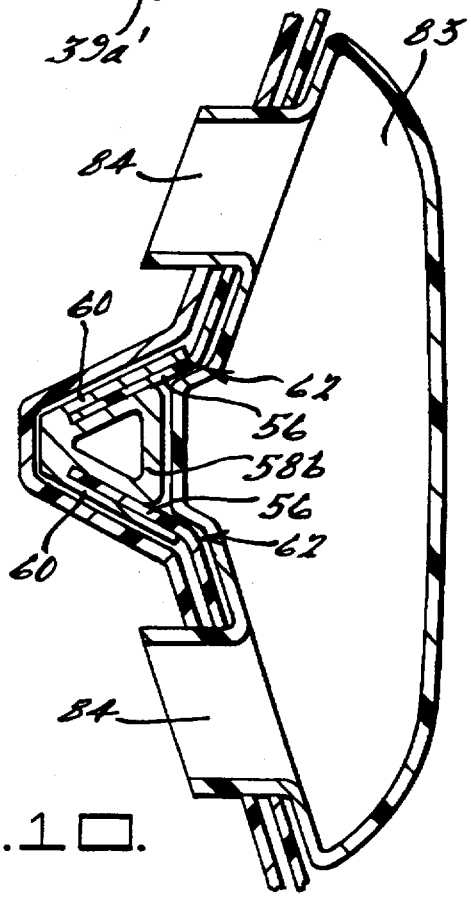
FIG. 10 is a cross-sectional view taken along line 10—10 in FIG. 2 showing the interlocking of adjacent wall panels of the cabana and showing the connection of the cabana vent stack with the cabana wall panels.

As shown in FIG. 10, side strips 56 of the wall panels 14a and 14b are shown inserted within the strip slots 62 of securing strip 60 of wall connector 58b in a frictional relationship. All interchangeable wall panels 14a–14e are interlocked in a like manner by these wall panel connectors so as to form a six-sided cabana enclosure, with the wall panel edges being substantially flush with one another at an angle defined by the base and the base surround segments.

In addition, lift handles, such as the lift handles 63, are affixed to the wall connectors to facilitate manual movement and placement of the cabana structure without the need for a forklift or other similar type of mechanical device, and to allow the cabana to be tilted for forklift blade access.

Referring again to FIG. 4, the door 20 hinged to the door frame and is preferably a VAC formed single skin door panel having a stiffened frame. The door frame 18 is secured to the wall panel connector 58f through door frame connecting panel 70b, with it being understood that the door frame is connected to the door frame connecting panel 70a in an identical manner. With reference to the door frame connecting panel 70b, the panel includes a lip, such as that shown at 72b, which engages with the slot 62 of the wall panel connector 58f. The door frame includes a channel 76 around its periphery for slidable engagement with a panel edge 74 to thereby secure the door frame on both sides to the connecting panels when the frame is properly positioned on the base. The frame 18 is further secured to the connecting panels by rivets (not shown) or any other similar fasteners. The frame also includes a tab 77 on each of its bottom edges that is sandwiched between the base and the base surround for securing the frame to the base.

The roof 20, as with the majority of the cabana structure, is preferably formed from a rotationally molded high density thermoplastic material such as polyethylene. The roof is formed to fit over the polygonally-shaped interior defined by the base and the wall panels. Also, the roof, in addition to defining extensions 46a–46e, cooperates with the wall panel recesses 49 to form cabana ventilation apertures that provide fresh air inlets to the cabana interior. The roof also defines a door frame recess 80 that fits in cooperating fashion over the top edge of the door frame 18.

As shown in FIG. 3, the vent stack 22 is also formed from rotationally-molded plastic. The vent stack is attached between two of the rear panels 14a, 14b in a lengthwise manner. The vent stack includes two vent slots 82 at its upper end and a pipe 83 (FIG. 10) extending from the vent slots to a pair of cabana interior access tubes 84 at its lower end that communicate with the cabana interior subsequent to bores being drilled through each of the wall panels adjacent to the location of the stack mounting. Through this configuration, air from the cabana interior is vented through the tubes 84 and out through the slotted vents 82.

Figure 8:
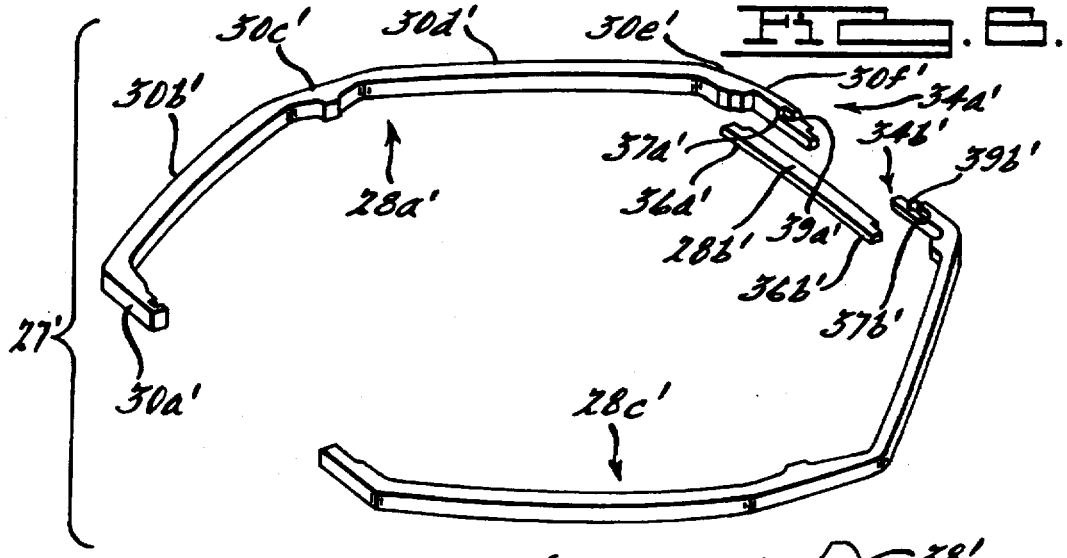
FIG. 8 is a top view showing the interior structure of the cabana of FIG. 1.
Figure 9:
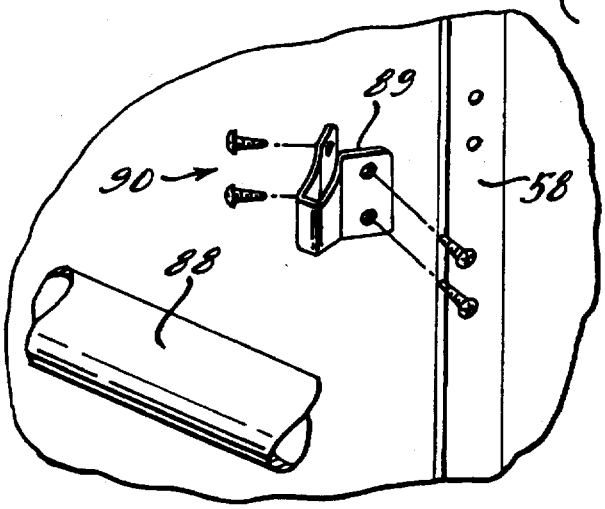
FIG. 9 is an exploded view showing connection of the interior wall rib to the cabana interior as shown in FIG. 5.

Referring now to FIG. 8, the interior of the cabana is shown. As shown, the interior of the cabana houses a toilet 85 including a holding tank 85a and a sink 86, also of the type typically installed in such units. The sink may be connected to a water supply tank located either on the interior of the cabana or located on the exterior of the cabana, as desired. Also, as shown, an interior wall rib 88 extends around the cabana interior formed by wall panels 14a–14e and is affixed generally horizontally to the interior surfaces of the wall connectors 58a–58f by brackets, such as the one shown at 89 in FIG. 9, secured to the connectors through self-tapping screws 90, and affixed to the rib through solder, self-tapping screws or similar fasteners. The interior rib extends behind the toilet 85 and around the sink 86. The interior rib serves a dual purpose: it increases the structural stability of the cabana through reinforcing the stability of the wall panels, while at the same time serves as a support rail for persons having physical disabilities limiting their mobility. Through gripping the rib, disabled people, such as those people confined to wheelchairs, are capable of lifting themselves off of a wheelchair and onto the toilet, and also from off of the toilet into proximity with the sink 86. This feature, in combination with the flat planar entryway through the door and the added volume afforded by the multi-sided structure, allows the cabana 10 to be used by persons with disabilities and other people with limited physical mobility, and especially those confined to a wheelchair.

It should be appreciated at this point that, although the cabana of the present invention is contemplated for use as a single toilet, single sink, restroom facility, the cabana 10 could be modified to house multiple urinals. It is also contemplated that the interior of the cabana 10 could also be fitted with a shower head or heads and be used as a showering facility. Further, it is contemplated that the cabana structure according to the present invention could be modified for indoor implementation in private dwellings in public locations such as shopping malls to enable persons with disabilities to access restroom facilities housed within the structure. It should be appreciated that the interior of the cabana of the present invention may also be configured as a multi-shower unit, a baby changing unit, a 'First Aid' unit or a contained smokers' corner.

As should be appreciated from the foregoing, the cabana 10, through use of the modular base surround, the wall connectors **56*a*–56*f* and the interior wall rib 86**, exhibits a high degree of structural integrity, thereby giving the cabana a high degree of durability, even when subjected to substantial amounts of abuse as is common with such portable toilet facilities during transportation and during movement. In addition, the cabana of the present invention, through its unique base design in combination with its interior brace/disabled persons' access rail, permits the interior of the structure to be accessed by persons having physical impairments who would otherwise not be capable of or would have difficulty with accessing conventional portable toilet facilities.

This invention may be further developed within the scope of the following claims. Thus, the foregoing description is intended to be illustrative of an operative embodiment and not in a strictly limiting sense. Having fully described an operative embodiment of this invention.

I now claim:

1. A multi-sided portable cabana, comprising:

a generally flat, planar base;

a plurality of interchangeable wall panels coupled to said base and extending generally perpendicularly upwardly from said base to define a cabana interior;

a roof panel affixed atop said plurality of wall panels;

a door panel hinged to a door frame positioned between two of said plurality of wall panels, said door frame including a bottom edge generally coplanar with said flat base;

a plurality of wall connectors each being positioned between adjacent wall panels for interlocking said adjacent wall panels in a lengthwise manner; and a wall rib secured generally horizontally to an inner surface of at least two of said plurality of wall connectors and spaced apart therefrom within said cabana interior to increase structural integrity of said cabana and to function as an access rail for physically disabled persons.

2. The multi-sided portable cabana of claim 1, wherein each of said wall panels includes strips extending lengthwise along its sides for securing each of said wall panels with one of said plurality of wall connectors to an adjacent wall panel.

3. The multi-sided portable cabana of claim 2, wherein each of said plurality of wall connectors is generally triangular in shape and includes a pair of securing strips on opposing sides thereof, said securing strips defining strip slots for engaging said side strips of said adjacent wall panels.

4. The multi-sided portable cabana of claim 3, further comprising a plurality of lifting handles affixed to said plurality of wall connectors to facilitate manual lifting and moving of said enclosure.

5. The multi-sided portable cabana of claim 1, wherein each of said plurality of wall panels includes a recessed portion along its lower width and said base further includes a base surround defining a peripheral shoulder around said base for cooperating with each of said recessed portions of said plurality of wall panels to increase the structural integrity of said cabana and to ensure correct alignment of said plurality of wall panels.

6. The multi-sided portable cabana of claim 1, further comprising a pair of door frame connecting panels for connecting said door frame with adjacent wall panels.

7. The multi-sided portable cabana of claim 1, further comprising a vent stack positioned in a lengthwise manner between two of said wall panels, said vent stack including venting means at an upper end and a vent tube at a lower end communicating with said cabana interior for passing air from said cabana interior through said vent means.

8. The multi-sided portable cabana of claim 1, further comprising a toilet positioned within said plurality of wall panels and in proximity to said wall brace.

9. The multi-sided portable cabana of claim 1, wherein said cabana is hexagonally shaped and said plurality of interchangeable wall panels comprises five wall panels.

10. A portable stand alone restroom facility, comprising:

a generally planar base having a plurality of sides; a base surround formed from elongated strips cooperatively engaged in a lengthwise manner and peripherally positioned around said base;

a plurality of interchangeable wall panels extending generally upwardly from said base and each having a recess along its lower width mateable with said base surround for increasing structural integrity of said facility, said plurality of wall panels defining a cabana interior;

a plurality of wall connectors interlocked in a lengthwise manner between adjacent wall panels to retain said wall panels and to increase structural integrity of said facility;

a roof panel operatively engaged with said plurality of wall panels;

a door including a door frame pivotably located between two of said plurality of wall panels; and a wall rib including mounting brackets for affixing said rib to said plurality of wall connectors within said cabana interior to increase structural integrity of said facility and to facilitate access to said cabana interior by physically disabled persons.

11. The portable stand alone restroom facility of claim 10, further comprising lifting handles affixed to said plurality of wall connectors for facilitating movement of said cabana.

12. The portable stand alone restroom facility of claim 10, wherein said wall panels include an upper end defining two flanges and an indent located therebetween, said indents cooperating with said roof panel to form a plurality of cabana vents therebetween.

13. A portable stand-alone restroom facility, comprising:

a generally flat planar base having a plurality of sides;

a base surround attached to said base and defining a peripheral shoulder around said base;

a plurality of wall panels each extending generally perpendicularly upwardly from said base to define a cabana interior, each of said plurality of wall panels defining a recess along its lower edge that engages with a portion of said base surround to increase cabana structural integrity;

a door panel hinged to a door frame positioned between two of said plurality of wall panels and including a bottom edge generally coplanar with said base;

each of said wall panels including side strips extending lengthwise along its sides for securing said wall panel to adjacent wall panels;

a plurality of wall connectors each being positioned between adjacent wall panels for interlocking said adjacent wall panels in a lengthwise manner, each of said plurality of wall connectors being generally triangular in shape and including a pair of securing strips on opposing sides thereof, said securing strips defining strip slots for engaging said side strips of said adjacent wall panels;

a vent stack positioned in a lengthwise manner between two of said panels and including venting means at an upper end and a vent flange at a lower end communicating with said cabana interior for passing air from said cabana interior through said vent means; and a wall rib secured generally horizontally to an inner surface of at least two of said plurality of wall connectors and spaced apart therefrom within said cabana interior thereby increasing said cabana structural integrity and functioning as an access rail for physically disabled persons.

* * * * *